US010734766B2

(12) United States Patent
Naganuma et al.

(10) Patent No.: US 10,734,766 B2
(45) Date of Patent: Aug. 4, 2020

(54) CABLE CONNECTOR INCLUDING RISING PORTIONS FOR CABLE CONNECTION AND ELECTRICAL CONNECTOR APPARATUS USING THE SAME

(71) Applicant: HIROSE ELECTRIC CO., LTD., Tokyo (JP)

(72) Inventors: Kenichi Naganuma, Tokyo (JP); Hayato Sato, Tokyo (JP)

(73) Assignee: HIROSE ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 16/606,029

(22) PCT Filed: Mar. 27, 2018

(86) PCT No.: PCT/JP2018/012353
§ 371 (c)(1),
(2) Date: Oct. 17, 2019

(87) PCT Pub. No.: WO2018/193796
PCT Pub. Date: Oct. 25, 2018

(65) Prior Publication Data

US 2020/0044395 A1 Feb. 6, 2020

(30) Foreign Application Priority Data

Apr. 20, 2017 (JP) ..... 2017-083832

(51) Int. Cl.
*H01R 4/66* (2006.01)
*H01R 13/6471* (2011.01)
(Continued)

(52) U.S. Cl.
CPC ..... *H01R 13/6471* (2013.01); *H01R 4/24* (2013.01); *H01R 13/6463* (2013.01)

(58) Field of Classification Search
CPC .. H01R 23/688; H01R 23/6873; H01R 12/57; H01R 33/971; H01R 23/7057; H01R 23/725
See application file for complete search history.

(56) References Cited

U.S. PATENT DOCUMENTS 4,826,449 A * 5/1989 Debortoli ..... H01R 4/2433 439/411
5,941,734 A 8/1999 Ikeda et al.
(Continued)

FOREIGN PATENT DOCUMENTS

JP 09-180799 A 7/1997
JP 2004-079377 A 3/2004
(Continued)

OTHER PUBLICATIONS

International Search Report (ISR) dated Jun. 12, 2018 filed in PCT/JP2018/012353.

*Primary Examiner* — Phuong Chi Thi Nguyen
(74) *Attorney, Agent, or Firm* — Rankin, Hill & Clark LLP

(57) ABSTRACT

For example, a cable connector including rising portions for cable connection is provided in which transmission characteristics are excellent and connection work can be easily conducted. Two pairs of signal terminals (11B-11E) and a ground terminal (11A) placed between the pairs of signal terminals are included. These terminals (11A-11E) include rising portions (11Ab-11Eb) exposed from a terminal support member, the rising portions rising from a principal surface, which has a terminal-to-terminal direction and a length direction, of the terminal support member toward a cable connection side in a height direction. At least part of the rising portion (11Ab) of the ground terminal is positioned within an area of an intersection region of a first virtual portion (1*a*) positioned in the terminal-to-terminal
(Continued)

direction between the rising portion (11B) of the signal terminal that is adjacent to the ground terminal (11A) and included in one of the pairs and the rising portion (11C) of the signal terminal included in the other pair, and a second virtual portion (a2) positioned between the same rising portions in the length direction, within at least one plane that is orthogonal to the height direction and spreads parallel to the principal surface of the terminal support member.

13 Claims, 12 Drawing Sheets

(51) Int. Cl.
*H01R 4/24* (2018.01)
*H01R 13/6463* (2011.01)

(56) References Cited

U.S. PATENT DOCUMENTS

| | | | | |
|---|---|---|---|---|
| 9,496,626 | B2 * | 11/2016 | King, Jr. | H01R 13/533 |
| 10,476,212 | B2 * | 11/2019 | Bopp | H01R 4/2429 |
| 2003/0003793 | A1 * | 1/2003 | Chang | H01R 31/08 439/402 |
| 2006/0270271 | A1 | 11/2006 | Moriyama et al. | |
| 2007/0082539 | A1 * | 4/2007 | Pavlovic | H01R 13/58 439/400 |
| 2007/0149032 | A1 | 6/2007 | Saito et al. | |
| 2008/0014783 | A1 * | 1/2008 | Shimirak | H01R 13/6666 439/417 |

FOREIGN PATENT DOCUMENTS

| | | | |
|---|---|---|---|
| JP | 2007-012588 | A | 1/2007 |
| JP | 4623584 | B2 | 2/2011 |

* cited by examiner

CABLE CONNECTOR INCLUDING RISING PORTIONS FOR CABLE CONNECTION AND ELECTRICAL CONNECTOR APPARATUS USING THE SAME

TECHNICAL FIELD

The present invention relates to a cable connector, or more specifically a cable connector including rising portions for cable connection and an electrical connector apparatus using the same.

BACKGROUND ART

For example, Japanese Patent No. 4623584 (Patent Literature 1) discloses an example of a cable connector. An object of the cable connector disclosed therein is to provide a cable connector that solves a problem occurring due to adjacently placing signal pairs, for example, a crosstalk problem, in which transmission characteristics are excellent and connection work can be easily conducted.

CITATION LIST

Patent Literature

Patent Literature 1: Japanese Patent No. 4623584

SUMMARY OF THE INVENTION

Problems to be Solved by the Invention

The connection work is conducted by soldering in many cases, and is also conducted manually in many cases. As a result, the connection state tends to become unstable, which may adversely affect the signal characteristics depending on, for example, the amount of solder used or the connection direction of wires. The soldering work needs considerable experience.

In order to simplify the work, the connection work may be conducted using pressure welding. In this case, a rising portion is used which is exposed from a housing that supports a terminal by, for example, causing part of the terminal to rise from a principal surface of the housing toward a cable connection side. A tip of the rising portion is provided with a gap that allows cutting a jacket of the cable. It is configured in such a manner that the cable is simply pressed into the clearance to easily cut the jacket and allow connecting an exposed core to the rising portion.

However, if such rising portions are provided, the rising portions exposed from the housing are directly close to each other not via the housing. As a result, there occurs a problem that the transmission characteristics are deteriorated.

The present invention is made to solve such a problem in the known technology, and an object thereof is especially to provide a cable connector including rising portions for cable connection, in which transmission characteristics are excellent and connection work can be easily conducted, and an electrical connector apparatus using the same.

Solutions to the Problems

In order to solve the above problem, a cable connector according to an aspect of the present invention is a cable connector including: a plurality of terminals; and a terminal support member configured to support the plurality of terminals, in which the plurality of terminals includes at least two pairs of signal terminals placed away from each other in a terminal-to-terminal direction, and at least one ground terminal placed in the terminal-to-terminal direction between one of the two pairs of signal terminals and the other pair of signal terminals, each of the plurality of terminals includes a support portion configured to be supported by the terminal support member, a contact portion configured to be brought into contact with a counterpart terminal, and a rising portion exposed from the terminal support member, the rising portion rising from a principal surface, which has the terminal-to-terminal direction and a length direction of the terminal orthogonal to the terminal-to-terminal direction (β), of the terminal support member toward a cable connection side in a height direction orthogonal to both of the terminal-to-terminal direction and the length direction, the ground terminal includes a first rising portion, the signal terminal placed on a side near the ground terminal in the terminal-to-terminal direction among the signal terminals included in the one of the pairs of signal terminals includes a second rising portion, the signal terminal placed on a side near the ground terminal in the terminal-to-terminal direction among the signal terminals included in the other pair of signal terminals includes a third rising portion, and the second and third rising portions are connectable to the cable, and at least part of the first rising portion is positioned within an area of an intersection region of a first virtual portion positioned in the terminal-to-terminal direction between the second and third rising portions and a second virtual portion positioned in the length direction between the second and third rising portions within at least one plane that is orthogonal to the height direction and spreads parallel to the principal surface.

According to the cable connector of the aspect, it is possible to provide a cable connector including rising portions for cable connection, in which transmission characteristics are excellent and connection work can be easily conducted, and an electrical connector apparatus using the same.

In the cable connector of the above aspect, in order to reduce noise more effectively, one of the second and third rising portions may be positioned in the length direction on a side nearer to a contact side with the counterpart terminal, or on a side farther from the contact side with the counterpart terminal, than the first rising portion, and the other may be positioned correspondingly in the length direction on the side farther from the contact side with the counterpart terminal, or the side nearer to the contact side with the counterpart terminal, than the first rising portion.

In the cable connector of the above aspect, in order to reduce the size of the apparatus, the second and third rising portions may be positioned at the same position in the length direction. Furthermore, the first, second, and third rising portions may be positioned at the same position in the length direction.

Moreover, in the cable connector of the above aspect, in order to reduce noise more effectively, the signal terminal placed in the terminal-to-terminal direction on a side far from the ground terminal among the signal terminals included in the one of the pairs of signal terminals may include a fourth rising portion, the signal terminal placed in the terminal-to-terminal direction on a side far from the ground terminal among the signal terminals included in the other pair of signal terminals may include a fifth rising portion, and the fourth and fifth rising portions may be connectable to the cable, and the fourth rising portion may be positioned in the length direction on a side nearer to a contact side with the counterpart terminal, or on a side farther from the contact side with the counterpart terminal, than the first rising portion, and the fifth rising portion may be positioned correspondingly in the length direction on the side farther away from the contact point with the counterpart terminal, or on the side nearer to the contact side with the counterpart terminal, than the first rising portion.

In the cable connector of the above aspect, in order to reduce the size of the apparatus, the signal terminal placed in the terminal-to-terminal direction on a side far from the ground terminal among the signal terminals included in the one of the pairs of signal terminals may include a fourth rising portion, the signal terminal placed in the terminal-to-terminal direction on a side far from the ground terminal among the signal terminals included in the other pair of signal terminals may include a fifth rising portion, and the fourth and fifth rising portions may be connectable to the cable, and the fourth and fifth rising portions may be positioned at the same position in the length direction.

Furthermore, the first, fourth, and fifth rising portions may be positioned at the same position in the length direction.

Furthermore, in the cable connector of the above aspect, considering both of noise reduction and a reduction in the size of the apparatus, it is preferable that the first, second, and fourth rising portions form an isosceles triangle with the second rising portion as the apex. Moreover, it is preferable that the first, third, and fifth rising portions form an isosceles triangle with the third rising portion as the apex.

In the cable connector of the above aspect, the rising portion may include a portion extending in the terminal-to-terminal direction, and may include a portion extending in the length direction.

Moreover, in the cable connector of the above aspect, the rising portion may include a groove for cutting along the height direction, the rising portion being configured to be capable of cutting part of the cable.

Moreover, in the cable connector of the above aspect, it is preferable that between the plurality of terminals, at least the support portions and the contact portions of the terminals have the same lengths in the length direction, and be positioned at the same heights in the height direction.

Effects of the Invention

According to the present invention, it is possible to provide a cable connector including rising portions for cable connection, in which transmission characteristics are excellent and connection work can be easily conducted, and an electrical connector apparatus using the same.

DESCRIPTION OF THE EMBODIMENTS

A cable connector according to a preferred embodiment of the present invention is described hereinafter with reference to the accompanying drawings. Only the preferred embodiment of the present invention is illustrated here, but naturally is not intended to limit the present invention.

Figure 1:
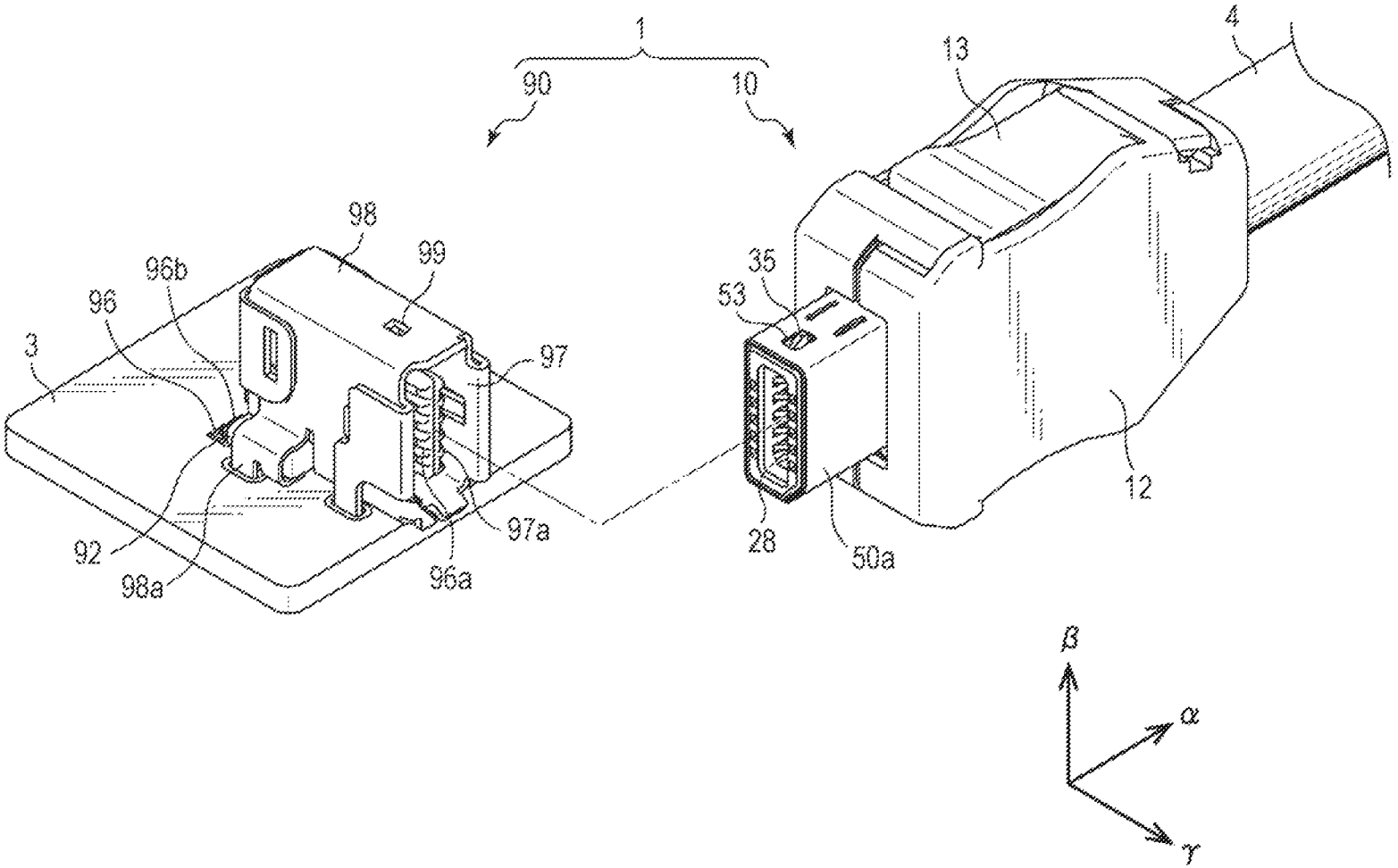
FIG. 1 is a perspective view of an electrical connector apparatus using a cable connector according to the present invention.

FIG. 1 is a perspective view of an electrical connector apparatus 1 using a cable connector 10 according to the present invention. The electrical connector apparatus 1 includes a pair of the cable connector 10 and a counterpart connector 90. The counterpart connector 90 may be, for example, a board-mounted type of connector connected to a board 3. However, as in the cable connector 10, the counterpart connector 90 may also be of a cable connection type. The cable connector 10 can be mated with and removed from the board connector 90.

The mating of the cable connector 10 and the board connector 90 can be locked using their shells. When the cable connector 10 and the board connector 90 are mated, a tapered mated portion 50*a* provided to the shell of the cable connector 10 is inserted into a substantially rectangular mating hole 97 provided in a front surface of the board connector 90. Lock portions protruding elastically from upper and lower sides of the tip portion 50*a* of the cable connector 10, for example, lock protruding portions 35 protruding elastically from shell holes 53, are fitted into locked portions provided on a ceiling portion and a base plate portion of a shell 98 of the board connector 90, for example, through-holes 99. As a result, the mating of the cable connector 10 and the board connector 90 is locked. The lock can be released using, for example, a lock lug manipulation unit 13 provided to the cable connector 10.

The board connector 90 mainly includes an insulating housing 92 and terminals 96 held by the insulating housing 92 in a state of being partially exposed, and further includes the conductive shell 98 that covers an outer peripheral surface of the insulating housing 92.

The mating hole 97 with which part of the connector 10 can be mated is provided in a front surface of the insulating housing 92. A mating protruding portion 97*a* that is fitted into a mating recess 28 formed by a housing 20 of the connector 10 is further provided to the mating hole 97. One end sides 96*a* of the terminals 96 are arranged on the mating protruding portion 97*a* in a state of being exposed. On the other hand, the other end sides 96*b* of the terminals 96 are soldered to the board 3. A part 98*a* of the shell 98 is fixed at a predetermined position of the board 3. Consequently, the shell 98 is grounded to earth.

Figure 2:
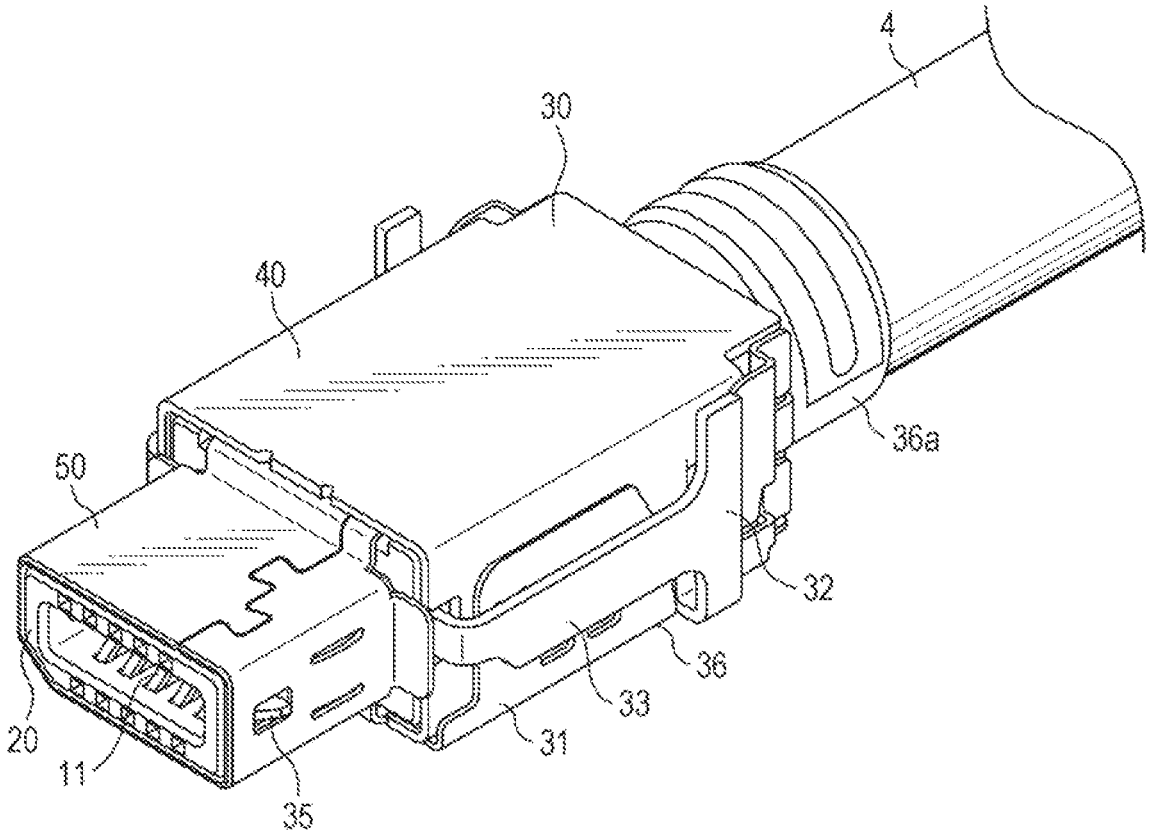
FIG. 2 is a perspective view of the cable connector from which a hood has been removed.
Figure 3:
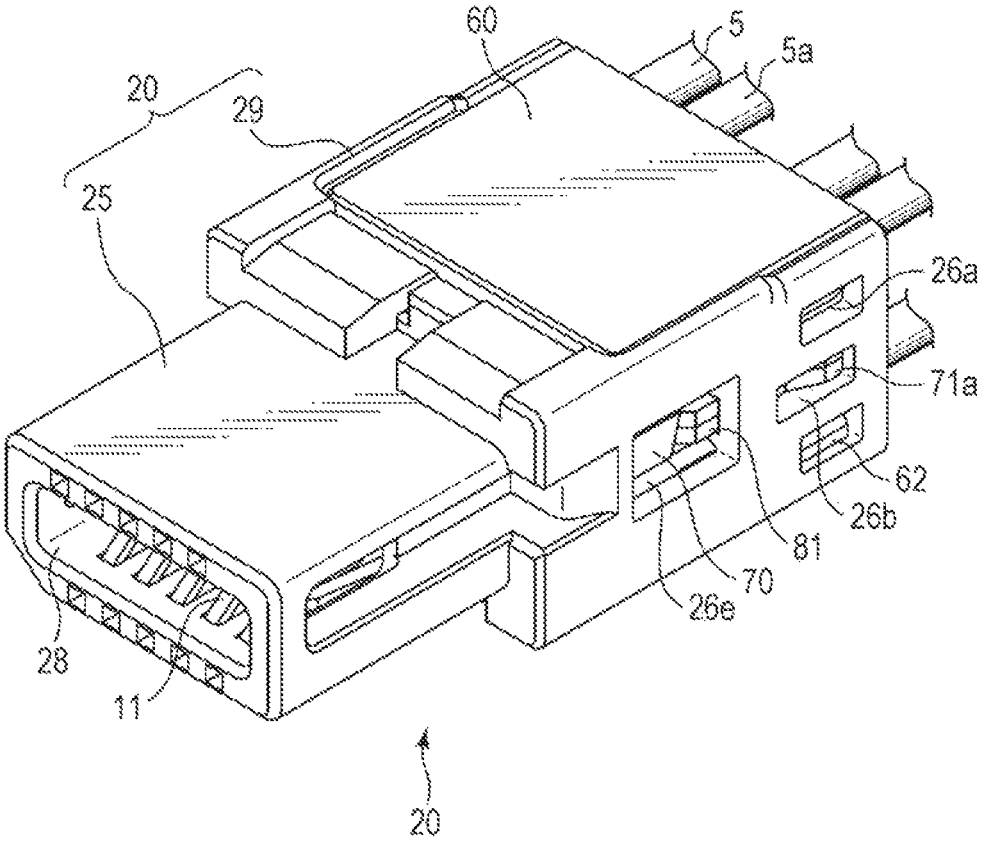
FIG. 3 is a perspective view of the state illustrated in FIG. 2 from which a shell has been removed.

FIG. 2 illustrates a perspective view of the cable connector 10 from which a hood 12 (refer to FIG. 1) has been removed. FIG. 3 illustrates a perspective view of the state illustrated in FIG. 2 from which a shell 30 and a jacket of an electrical cable 4 have been removed.

The cable connector 10 mainly includes the housing 20 including an insulating member such as resin, cable holders 60 that hold a plurality of twisted pair cables 5 included in the electrical cable 4, terminal support members 70 that support terminals 11, and the conductive shell 30 that covers outer peripheral surfaces of the housing 20 and the cable holders 60, and further includes the insulating hood 12 (refer to FIG. 1) that covers the outside of the shell 30. The cable holders 60 and the terminal support members 70 are used in a state of being integrated into the housing 20, and configure part of the housing 20 together with the housing. Accordingly, in a broad sense, the cable holders 60 and the terminal support members 70 can be recognized as the housing. Four twisted pair cables 5 in total are provided here.

As well illustrated in FIG. 2, the shell 30 includes a main body shell 31, a plate-shaped shell 40, and a tubular shell 50. The plate-shaped shell 40 and the main body shell 31 mainly cover outer peripheral surfaces of side portions of, for example, a housing body 29. The plate-shaped shell 40 mainly covers outer peripheral surfaces of the side portions of, for example, the housing body 29 that are not covered by the main body shell 31. The tubular shell 50 mainly covers outer peripheral surfaces of side portions of an inserted portion 25 with a slightly small diameter protruding from the housing body 29.

The main body shell 31 is formed by blanking one metal plate and performing a bending process thereon. The main body shell 31 as a whole has a substantially U-shaped cross-section, and mainly includes a base 36, an elastic piece 33 extending frontward of the base 36, and a swaged portion 36*a* of the electrical cable 4 extending to the rear of the base 36. The base 36 and the elastic piece 33 are elastically connected at a rear end portion of the base 36 via a support portion 32 formed as a substantially U-shaped folded portion in cross-section. The elastic piece 33 includes a free end on the side mating with the board connector 90. Furthermore, the free end is provided with the lock protruding portions 35 used to be locked to the board connector 90.

Figure 4:
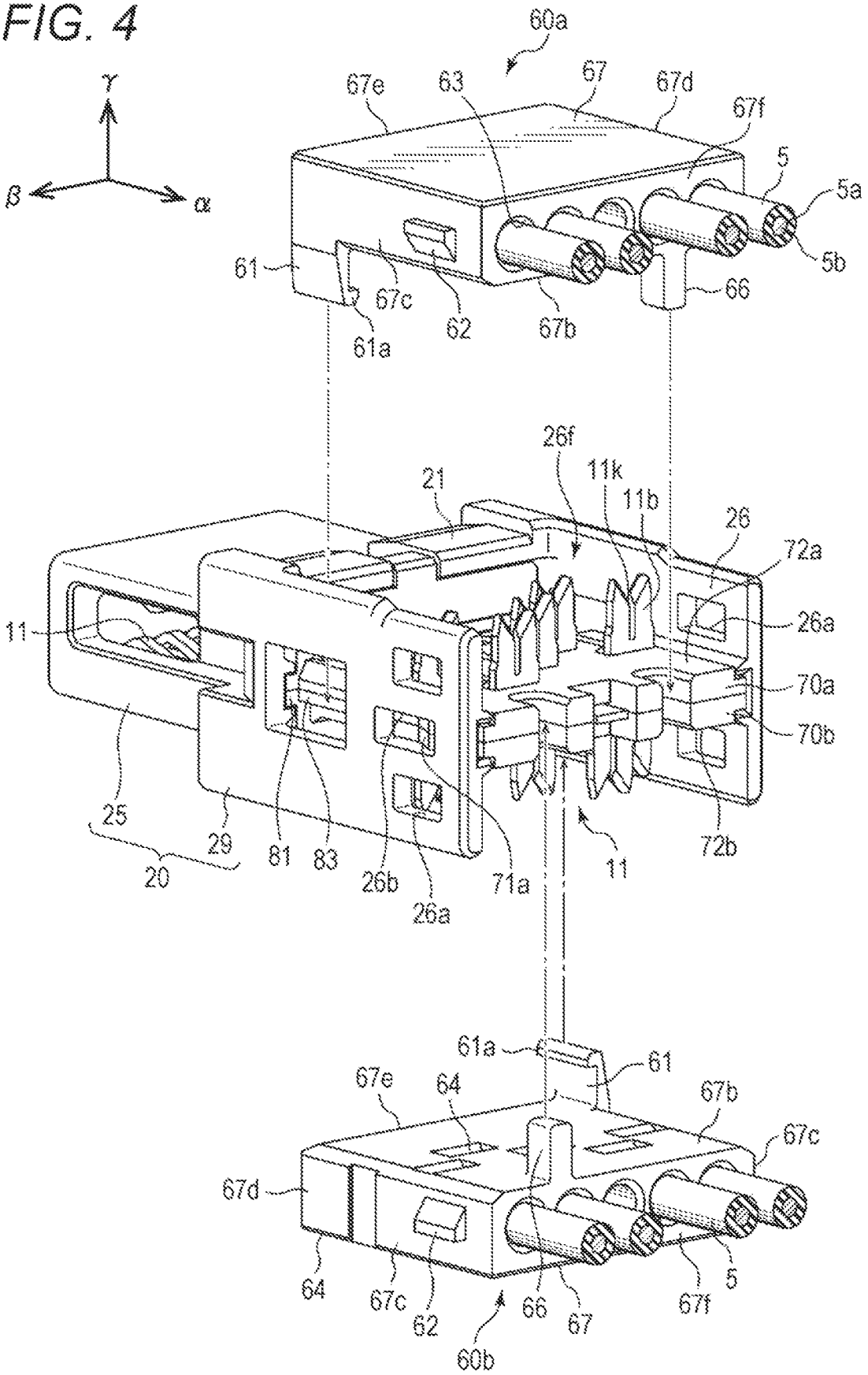
FIG. 4 is an exploded perspective view of FIG. 3.
Figure 5:
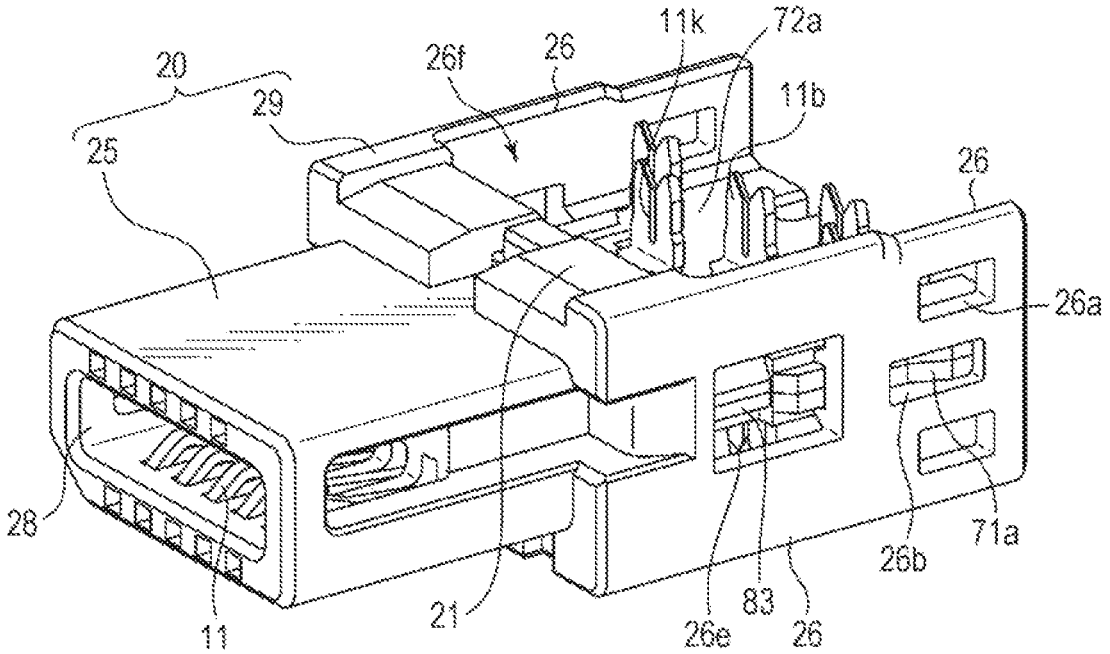
FIG. 5 is a front perspective view of a housing from which cable holders have been removed.

FIG. 4 illustrates a rear perspective view of a state where the cable holders 60 (60*a* and 60*b*) have been removed from the state of FIG. 3, together with the removed cable holders 60*a* and 60*b*. Moreover, FIG. 5 illustrates a front perspective view of the state where the cable holders 60*a* and 60*b* have been removed from the state of FIG. 3.

The housing 20 includes the housing body 29, and the inserted portion 25 protruding from the housing body 29 on the mating side with the board connector 90 (refer to FIG. 1). The inserted portion 25 is a portion that is inserted into the mating hole 97 (refer to FIG. 1) of the board connector 90. In the inserted portion 25, the mating recess 28 into which the mating protruding portion 97*a* of the board connector 90 is inserted is formed.

The housing body 29 includes a thick base 21 and two opposed plate-shaped side walls 26 extending rearward of the base 21, that is, to a side opposite to the inserted portion 25. The terminal support members 70*a* and 70*b*, which are paired, and the cable holders 60*a* and 60*b*, which are similarly paired, are installed in a space 26*f* formed between the side walls 26. The housing body 29 is formed into a substantially cuboid shape by being complemented by the terminal support members 70*a* and 70*b* and the cable holders 60.

It is preferable that the paired cable holders 60*a* and 60*b* have the same size and shape as each other. Similarly, it is preferable that the paired terminal support members 70*a* and 70*b* have the same size and shape as each other. They are formed in the same sizes and shapes to facilitate the parts management, which also simplifies the manufacturing process.

Each of the cable holders 60*a* and 60*b* includes a substantially cuboid main body 67, and a cantilevered arm portion 61 extending from the main body 67 along a mounding direction "γ" of the cable holder 60 on the housing 20. The arm portion 61 is coupled to the main body 67 on one end side opposite to the free end side. The arm portion 61 is provided in such a manner as to be elastically displaceable in a thickness direction. The main body 67 is provided with a plurality of through-holes 63 through which the cables 5 are inserted along a length direction "α" of the cables 5. These through-holes 63 are used to mount one end sides of the twisted pair cables 5 in the cable holders 60. The mounted one end side of the twisted pair cable leads from a rear surface 67*f* side to near a front surface 67*e* side of the main body 67. The inner diameter of the through-hole 63 is set to be substantially equal to or slightly smaller than the outer diameter of the cable 5. Consequently, an outer peripheral surface of the cable 5 is caught on an inner peripheral surface of the through-hole 63, which makes it possible to prevent the cable 5 from accidentally coming out of the through-hole 63.

Side surfaces 67*c* and 67*d* on the left and right sides of the main body 67 are each provided with a latch protruding portion 62 that latches in a latch hole 26*a* (refer to FIG. 3 to FIG. 5) provided in the side wall 26 of the housing 20. Moreover, latch protruding portions 61*a* that are latched to latch protruding portions 83 (refer to FIGS. 4 to 6) provided on vertically arranged portions 75*a* and 75*b* of the terminal support members 70*a* and 70*b* are provided near the free ends of the arms 61. The latch protruding portions 62 of these cable holders 60*a* and 60*b* and the latch holes 26*a* on the housing side 20, and the latch protruding portions 61*a* of the cable holders 60*a* and 60*b* and the latch protruding portions 83 of the terminal support members 70*a* and 70*b* are provided along the mounting direction "γ" of the cable holders 60 on the housing 20. These latch means are used to enable latching of the cable holders 60 to the housing 20. In this manner, in the embodiment, the latching between the latch protruding portions 62 of the cable holders 60*a* and 60*b* and the latch holes 26*a* on the housing 20 side, and the latching between the latch protruding portions 61*a* of the cable holders 60*a* and 60*b* and the latch protruding portions 83 of the terminal support members 70*a* and 70*b* causes the cable holders 60 to be latched at different points to the housing 20 and the terminal support members 70. Accordingly, the fixing between the housing 20, the terminal support members 70, and the cable holders 60 can be strengthened. A side surface on each of the left and right sides of the vertically arranged portions 75*a* and 75*b* is provided with a latch protruding portion 81 that is latched using a groove provided on an inner surface of the side wall 26 of the housing body 29.

Insertion holes 64 through which rising portions (11*b*) protruding from principal surfaces 72 (72*a* and 72*b*) of the terminal support members 70*a* and 70*b* are later inserted are provided in undersurfaces 67*b* of the main bodies 67. The insertion hole 64 communicates with the through-hole 63 through which the twisted pair cable 5 is inserted. It is configured in such a manner that an insulating sheath 5*a* (refer to FIG. 4) of the twisted pair cable 5 inserted through the through-hole 63 can be cut by a groove 11*k* for cutting provided in the rising portion 11*b* when the cable holders 60*a* and 60*b* are mounted on the housing 20. As a result, an internal core 5*b* (refer to FIG. 4) is caught in the groove to establish electrical continuity between the cable 5 and the terminal 11.

Moreover, protruding portions 66*a* and 66*b* that are fitted into notches 76*a* and 76*b* provided in the terminal support members 70*a* and 70*b* are provided on the undersurfaces 67*b* of the main bodies 67. The protruding portions 66*a* and 66*b* are vertically arranged on surfaces of the cable holders 60*a* and 60*b* on the mounting sides on the housing 20, that is, the undersurfaces 67*b*, in the mounting direction "γ" of the cable holders 60*a* and 60*b* on the housing 20, that is, in the same direction as the arm portions 61.

Figure 6:
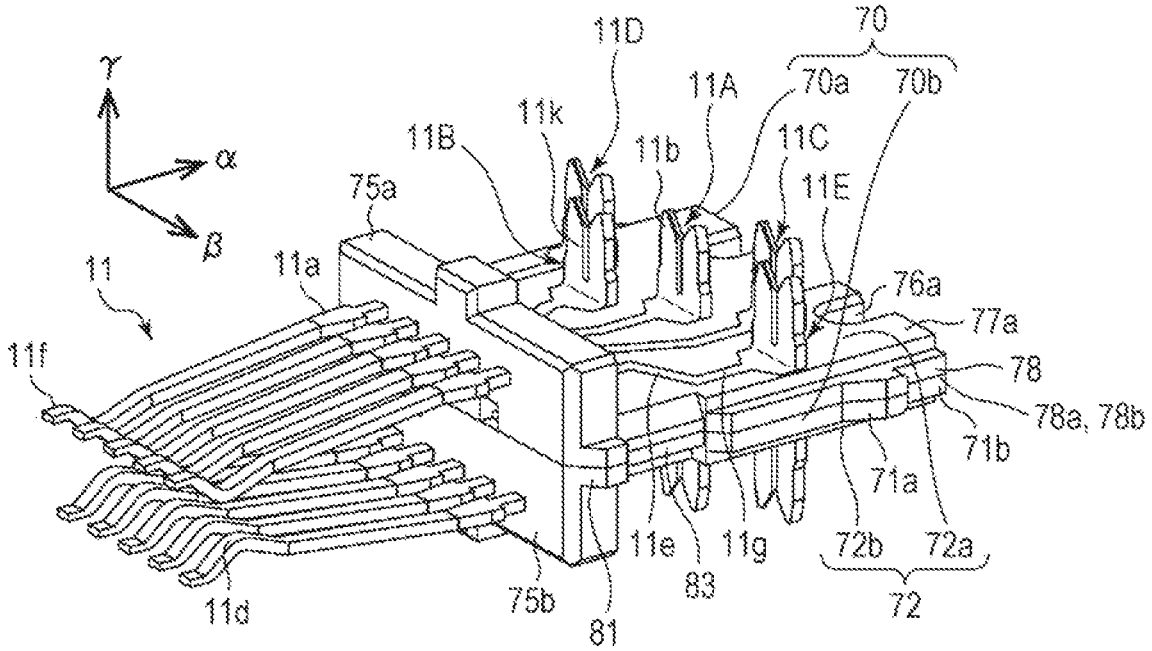
FIG. 6 is a perspective view illustrating terminal support members together with terminals.
Figure 7:
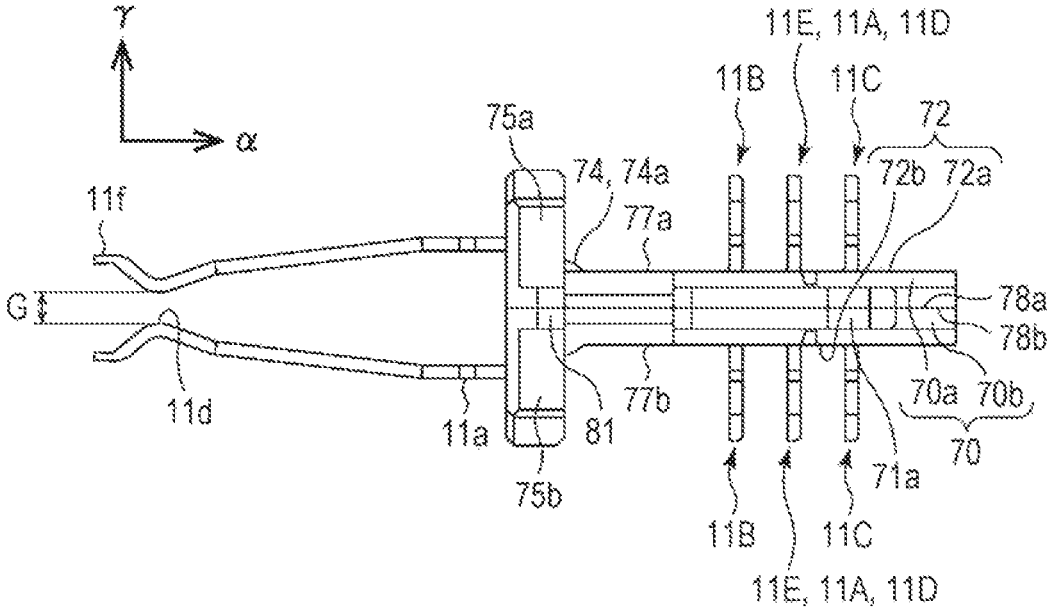
FIG. 7 is a side view of the configuration illustrated in FIG. 6.
Figure 8:
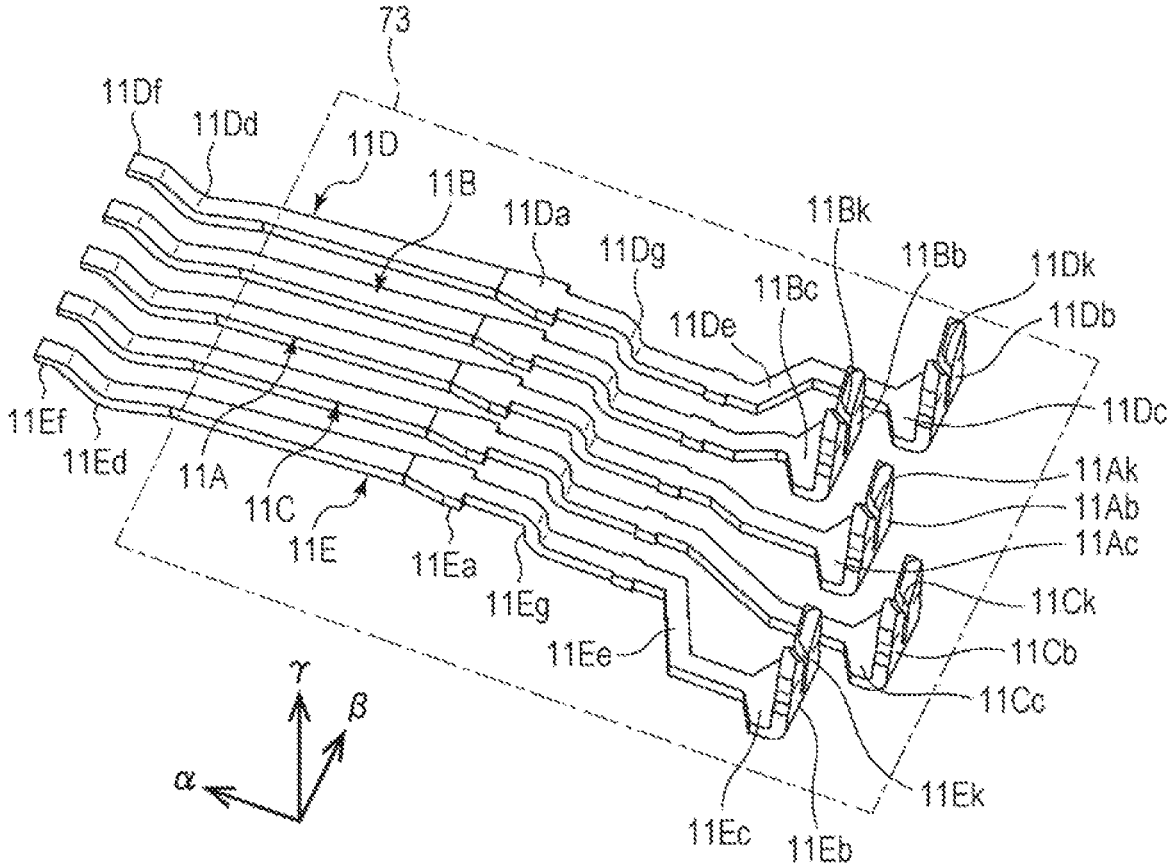
FIG. 8 is a perspective view illustrating the arranged state of the terminals supported by the terminal support member.
Figure 9:
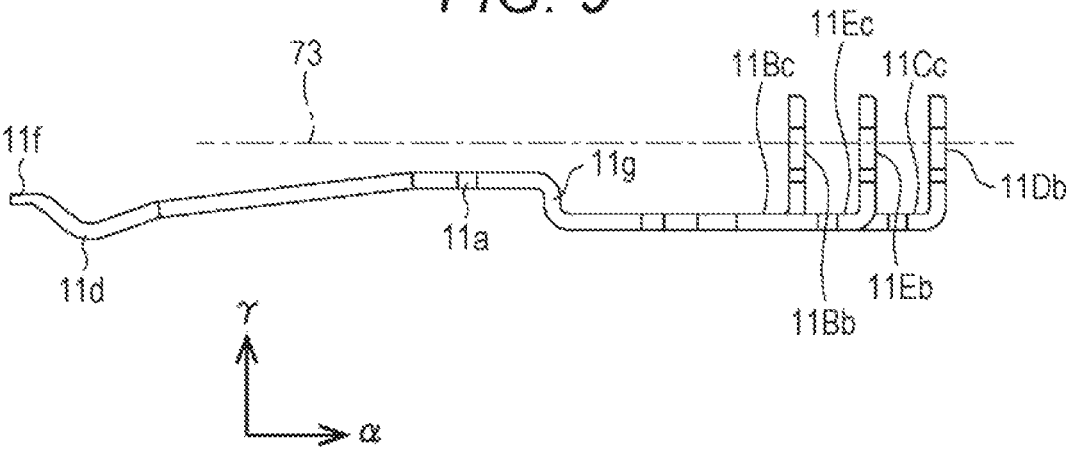
FIG. 9 is a side view of the configuration illustrated in FIG. 8.

FIG. 6 illustrates a perspective view of the terminal support members 70*a* and 70*b* together with the terminals 11. FIG. 7 illustrates a side view of the configuration illustrated in FIG. 6. Furthermore, FIG. 8 illustrates a perspective view of the arranged state of the terminals 11 supported by the terminal support member 70. FIG. 9 illustrates a side view of the configuration illustrated in FIG. 8.

The cable connector 10 is provided with a plurality of, for example, five terminals 11A to 11E so as to be adaptable to Category 6a based on IEEE 802.3 here. These terminals 11A to 11E include two pairs of the signal terminals (11B and 11D) and (11C and 11E) placed away from each other in a terminal-to-terminal direction "β", and the ground terminal 11A placed in the terminal-to-terminal direction "β" between one (11B and 11D) of the two pairs of the signal terminals (11B and 11D) and (11C and 11E) and the other pair of the signal terminals (11C and 11E). From the viewpoint of reducing, for example, crosstalk, it is preferable that the terminals 11A to 11E be placed the same terminal-to-terminal distance away from each other. Furthermore, the one signal terminal pair (11B and 11D) includes the signal terminal 11B placed on a side near the ground terminal 11A in the terminal-to-terminal direction "β", and the signal terminal 11D placed on a side far from the ground terminal 11A in the terminal-to-terminal direction "β". Moreover, the other signal terminal pair (11C and 11E) includes the signal terminal 11C placed on a side near the ground terminal 11A in the terminal-to-terminal direction "β", and the signal terminal 11E placed on a side far from the ground terminal 11A in the terminal-to-terminal direction "β".

Each of the terminals 11A to 11E is formed by blanking a sheet of metal and bending the blank, and includes a contact portion 11*d* provided on a tip side 11*f* that is brought into contact with a counterpart terminal (the terminal "96" in FIG. 1), a latch portion 11*a* for being press-fitted in and latched to the housing 20, a support portion 11*g* supported by the terminal support member 70, and cable connection portions (11*b* and 11*c*) that are connected to the cable 5 (refer to, for example, FIG. 4).

The contact portion 11*d* is a portion that is brought into contact with the counterpart terminal, and includes, for example, a contact provided near the tip 11*f* of the terminal. However, the contact portion 11*d* is not limited to the contact; the contact portion 11*d* also includes the portion that is brought into contact with the counterpart terminal widely.

The support portion 11*g* is a portion supported by the terminal support member 70, and is formed integrally with the terminal support member 70, but may be of a type that is press-fitted in the terminal support member 70. The support portion 11*g* may be formed as a bend portion formed into a substantially "S" shape. The support portions 11*g* can also be supported by the vertically arranged portions 75*a* and 75*b* of the terminal support members 70.

It is preferable that between the terminals 11A to 11E, the support portions 11*g* and the contact portions 11*d* have the same lengths in a length direction "α" of the terminals 11A to 11E (corresponding to the length direction "α" of the cable 5) orthogonal to the terminal-to-terminal direction "β", and be positioned at the same heights in a height direction "γ" (corresponding to the above-mentioned mounting direction "γ") orthogonal to both of the terminal-to-terminal direction "β" and the length direction "α". Moreover, it is preferable that between the terminals 11A to 11E, the vertically arranged portions 75*a* and 75*b* be positioned at the same height in the height direction "γ", and have the same length in the height direction "γ" as in the support portions 11*g* and the contact portions 11*d*. Consequently, it is possible to prevent crosstalk more effectively. Moreover, in this case, it is also possible to use the ground terminal 11A as a signal terminal. Accordingly, this apparatus can also be used as not only a standard product of Category 6 of IEEE but also a standard product of, for example, Category 5.

The cable connection portion includes the flat portion 11*c* and the rising portion 11*b*. The flat portion 11*c* may have, for example, a substantially triangular shape in top view, and is designed to form part of the principal surface 72 (72*a* and 72*b*), which has the terminal-to-terminal direction "β" and the length direction "α", of the terminal support member 70 (70*a* and 70*b*), or more specifically part of a main surface of the terminal support member 70 (70*a* and 70*b*) supporting the vicinity of the flat surface 11*c*. The flat surface 11*c* is provided to each of the terminals 11A to 11E. The ground terminal 11A includes a ground-specific flat portion 11Ac. The signal terminals 11B to 11E include signal-specific flat portions 11Bc to 11Ec, respectively.

The rising portion 11*b* rises from the principal surface 72 of the terminal support member 70 toward the cable connection side in the height direction "γ" in a state of being exposed from the terminal support member 70.

Terminal-to-terminal distance changing portions 11Ae to 11Ee may be provided between the rising portions 11Ab to 11Eb and the support portions 11Ag to 11Eg to change the spacing between the terminals 11A to 11E in the terminal-to-terminal direction "β" (refer to FIG. 8). These terminal-to-terminal distance changing portions 11Ae to 11Ee are provided. Accordingly, it is possible to increase the distance between the rising portions 11Ab to 11Eb in the terminal-to-terminal direction "β" as compared to the distance between the tips 11Af to 11Ef, and to facilitate conducting pressure-welding work. These terminal-to-terminal distance changing portions 11Ae to 11Ee also play an important role in reducing crosstalk.

The terminal support members 70*a* and 70*b* support the terminals 11A to 11E in cantilever fashion. The terminals 11A to 11E may be integrated at their respective support portions 11Ag to Eg by integral molding at the time of manufacture to be supported by the terminal support members, or may be integrated with the terminal support members 70*a* and 70*b* from the rear or above, using press-fitting or the like to be supported there. In this example, a description is given assuming integral molding. Part of the terminal 11 is exposed to the outside even after being integrated. For example, front parts of the terminals 11A to 11E, in other words, the vicinities of the tips 11Af to 11Ef of the terminals 11A to 11E extending toward the base 21 side of the housing 20, and rear parts of the terminals 11, in other words, for example, the rising portions 11Ab to Eb where the twisted pair cables 5 are pressure welded, are exposed to the outside. The tips Af to 11Ef side of the terminals 11A to 11E can be elastically displaced along the height direction "γ".

The terminal support members 70*a* and 70*b* include plate-shaped main bodies 77*a* and 77*b* forming the principal surfaces 72*a* and 72*b*, respectively. The vertically arranged portions 75*a* and 75*b* are provided on top surfaces of the main bodies 77*a* and 77*b*, lock projections 71*a* protruding outward are provided on the left and right side surfaces of the main bodies 77*a* and 77*b*, and notches 76*a* and 76*b* of a U-shape in plan view cut out inward are provided in rear edges of the main bodies 77*a* and 7*b*.

At the time of assembly, the paired terminal support members 70*a* and 70*b* are abutted against each other on their flat undersurfaces 78*a* and 78*b* in the height direction "γ". These abutment surfaces are designed to be flat surfaces. With such surfaces, the abutment is made in a more stable state.

When the paired terminal support members 70*a* and 70*b* are abutted against each other, the terminals 11 supported by the terminal support members 70*a* and 70*b* form a gap "G" (refer to FIG. 7) into which a contacted object, for example, the mating protruding portion 97*a* of the board connector 90 (refer to FIG. 1), is inserted, between the contacts 11*d* of the terminals 11. The gap "G" is formed along the height direction "γ" along the abutment direction of the paired terminal support members 70.

It is preferable to provide extending portions 74 extending from the vertically arranged portions 75*a* and 75*b*, on the terminal support members 70*a* and 70*b*, to prevent, for example, parts of the cores exposed from the tips (distal ends) of the cables 5 held by the cable holders 60 from being short-circuited with their adjacent terminals. The extending portions 74 extend from the vertically arranged portions 75*a* and 75*b* toward the rising portions 11*b* side within the top surfaces of the terminal support members 70*a* and 70*b*, and cover at least parts of support portions 11*g* of the terminals 11. It is preferable that a taper 74*a* for preventing a collision with the cable holder 60 be formed at a tip of the extending portion 74.

Figure 10:
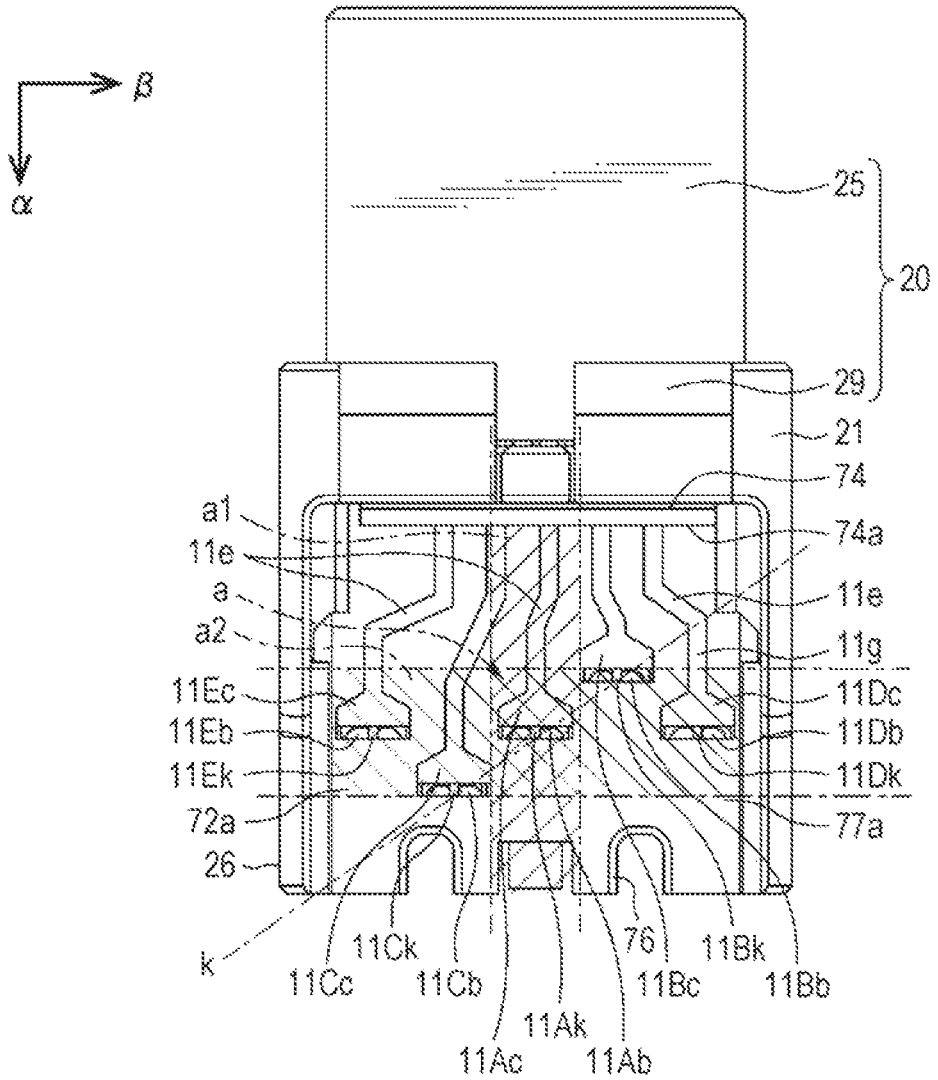
FIG. 10 is a plan view of the configuration illustrated in FIG. 5.
Figure 11:
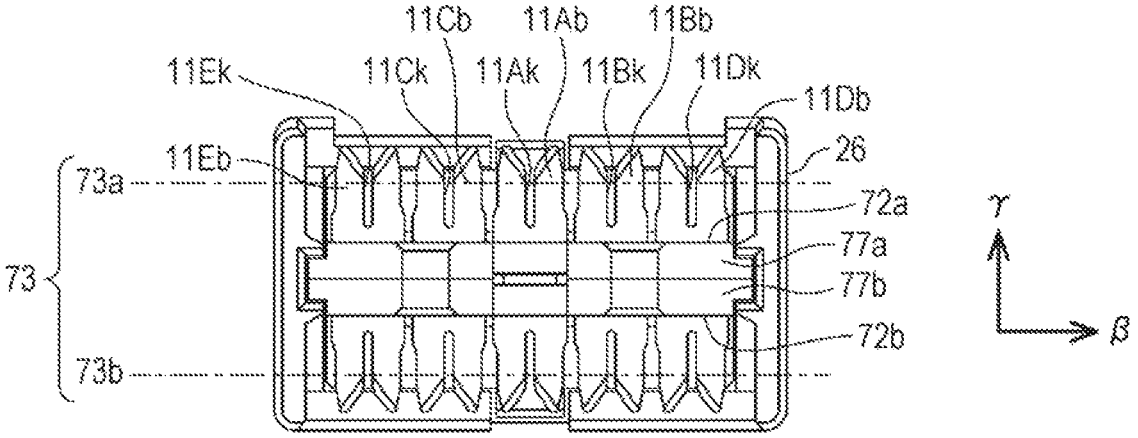
FIG. 11 is a rear view of the configuration illustrated in FIG. 10.

The terminal arrangement in the cable connector 10 is described with reference to FIGS. 10 and 11 in addition to FIGS. 8 and 9. FIG. 10 is a plan view of the configuration illustrated in FIG. 5. FIG. 11 is a rear view of the configuration illustrated in FIG. 5.

As illustrated in FIG. 10, at least part of the ground rising portion 11Ab of the ground terminal 11A is positioned within an area of an intersection region "a" of a first virtual portion "a1" positioned in the terminal-to-terminal direction "β" between the signal rising portions 11Bb and 11Cb and a second virtual portion "a2" positioned in the length direction "α" between the signal rising portions 11Bb and 11Cb within at least one plane that is orthogonal to the height direction "γ" and spreads parallel to the principal surface 72*a*/72*b* of the terminal support member 70, for example, within a plane 73 (73*a* and 73*b*) illustrated in FIGS. 8, 9, and 11.

The terminals are placed in this manner. Accordingly, the ground rising portion 11Ab faces the signal rising portions 11Bb and 11Eb within a plane in the same height direction. As a result, noise generated between the signal rising portions 11Bb and 11Db included in the one signal terminal pair (11B and 11D) and the signal rising portions 11Cb and 11Eb included in the other signal terminal pair (11C and 11E) (the occurrence of crosstalk) can be effectively reduced or be destroyed by the ground rising portion 11Ab provided between them.

In other words, lines of force generated between the signal rising portions 11Bb and 11Cb, between the signal rising portions 11Bb and 11Eb, between the signal rising portions 11Db and 11Cb, and between the signal rising portions 11Db and 11Eb can be effectively coupled to the ground rising portion 11Ab. Crosstalk can be effectively reduced or destroyed.

The "entire part" of the ground rising portion 11Ab in the height direction "γ" is not required to be positioned within the area of the intersection region "a" within the "entire" plane that is orthogonal to the height direction "γ" and spreads parallel to the principal surface 72*a* or 72*b*. Moreover, the "entire part" of the ground rising portion 11Ab is not required to be positioned within the area of the intersection region "a" within at least one plane. At least part of the ground rising portion 11Ab in the height direction "γ" is simply required to be positioned within the area of the intersection region "a" within at least one plane. This is because even in such a case, a line of force can be effectively coupled to the ground rising portion 11Ab.

It is preferable that as illustrated in FIG. 10, the ground rising portion 11Ab be placed on a straight line "k" linking the center of the signal rising portion 11Bb included in the one signal terminal pair (11B and 11D) and the center of the signal rising portion 11Cb included in the other signal terminal pair (11C and 11E), in other words, on the straight line "k" forming the shortest distance between the center of the signal rising portion 11Bb and the center of the signal rising portion 11Cb. Noise is most likely to occur at such a position. Accordingly, the ground rising portion 11Ab is placed at this position. Therefore, noise can be more effectively reduced. However, the placement is not limited to this position, but the ground rising portion 11Ab is simply required to be positioned within the above-mentioned area of the intersection region "a". This is because noise reaches not only on the straight line "k", but also a space existing between the signal terminal pairs three-dimensionally. Here, the straight line "k" is expressed as the line forming the shortest distance between the center of the signal rising portion 11Bb and the center of the signal rising portion 11Cb, but is not limited to this; the straight line "k" can also be regarded as, for example, a straight line forming the shortest distance between the signal rising portions (11Bb and 11Db) included in the one signal terminal pair (11B and 11D) and the signal rising portions (11Cb and 11Eb) included in the other signal terminal pair (11C and 11E).

Furthermore, in order to separate the signal rising portion 11Bb included in the one signal terminal pair (11B and 11D) and the signal rising portion 11Cb included in the other signal terminal pair (11C and 11E) as much as possible, one of the signal rising portions 11Bb and 11Cb may be positioned in the length direction "α" on a side nearer to or farther from a contact side with a counterpart terminal than the ground rising portion 11Ab, and the other may be positioned correspondingly on the side farther from or nearer to the contact side with the counterpart terminal than the ground rising portion 11Ab. For example, in the examples illustrated in FIG. 10 and the like, the signal rising portion 11Bb is positioned in the length direction "α" on the side nearer to the contact side with the counterpart terminal than the ground rising portion 11Ab, and the signal rising portion 11Cb is positioned correspondingly on the side farther from the contact side with the counterpart terminal than the ground rising portion 11Ab.

However, it is not necessarily required to perform positioning in this manner. From the viewpoint of the size of the apparatus, the signal rising portions 11Bb and 11Cb may be positioned at the same position in the length direction "α". For example, the signal rising portions 11Bb and 11Cb may be positioned at the same position as the ground rising portion 11Ab.

Similarly, in order to separate the signal rising portion 11Db included in the one signal terminal pair (11B and 11D) and the signal rising portion 11Eb included in the other signal terminal pair (11C and 11E) as much as possible, one of the signal rising portions 11Db and 11Eb may be positioned in the length direction "α" on a side nearer to or farther from a contact side with a counterpart terminal than the ground rising portion 11Ab, and the other may be positioned correspondingly on the side farther from or nearer to the contact side with the counterpart terminal than the ground rising portion 11Ab.

However, it is not necessarily required to perform positioning in this manner. From the viewpoint of the size of the apparatus, the signal rising portions 11Db and 11Eb may be positioned at the same position in the length direction "α". For example, in the examples illustrated in FIG. 10 and the like, the signal rising portions 11Db and 11Eb are positioned at the same position as the ground rising portion 11Ab in the length direction "α".

When both of noise reduction and a reduction in the size of the apparatus are taken into consideration, it is preferable that the ground rising portion 11Ab and the signal rising portions 11Bb and 11Db form an isosceles triangle with the signal rising portion 11Bb as the apex as illustrated in FIG. 10 and the like. Moreover, it is preferable that the ground rising portion 11Ab and the signal rising portions 11Cb and 11Eb form an isosceles triangle with the signal rising portion 11Cb as the apex. Furthermore, in this case, it is preferable that the signal rising portions 11Bb and 11Cb forming the apexes be positioned on opposite sides across the ground rising portion 11Ab in the length direction "α" as illustrated in FIG. 10 and the like.

Figure 12:
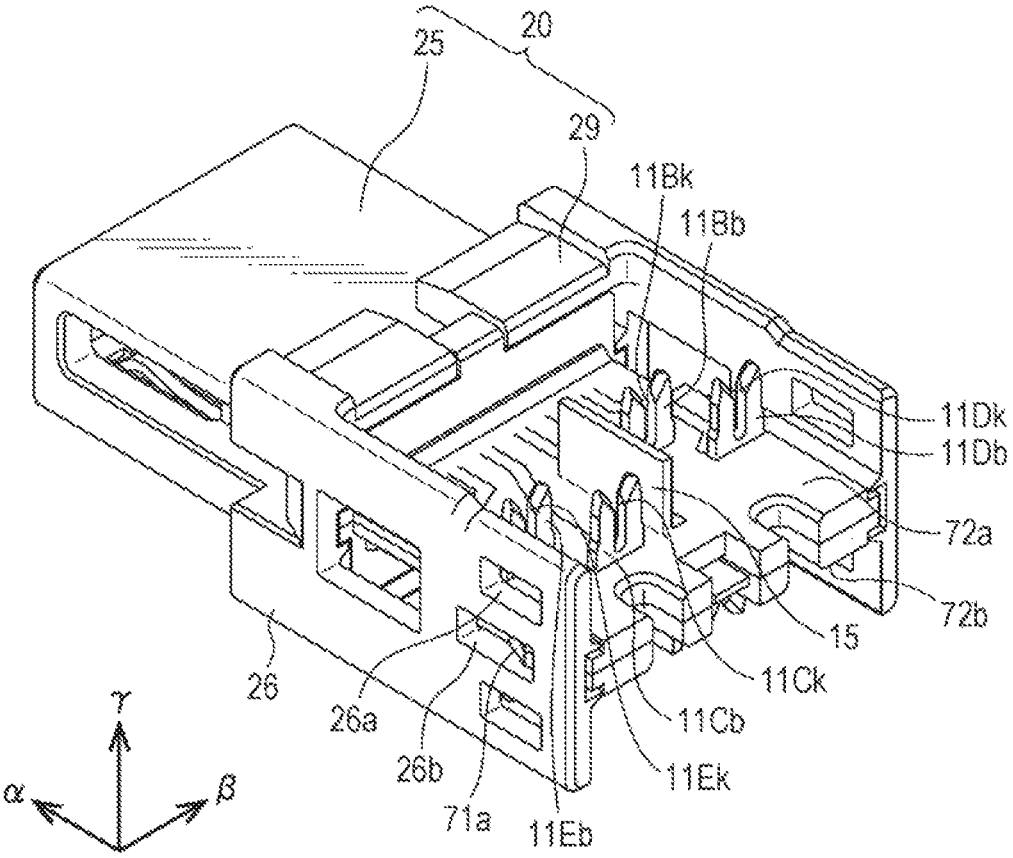
FIG. 12 is a diagram illustrating a modification, and is a rear perspective view of the housing from which the cable holders have been removed.
Figure 13:
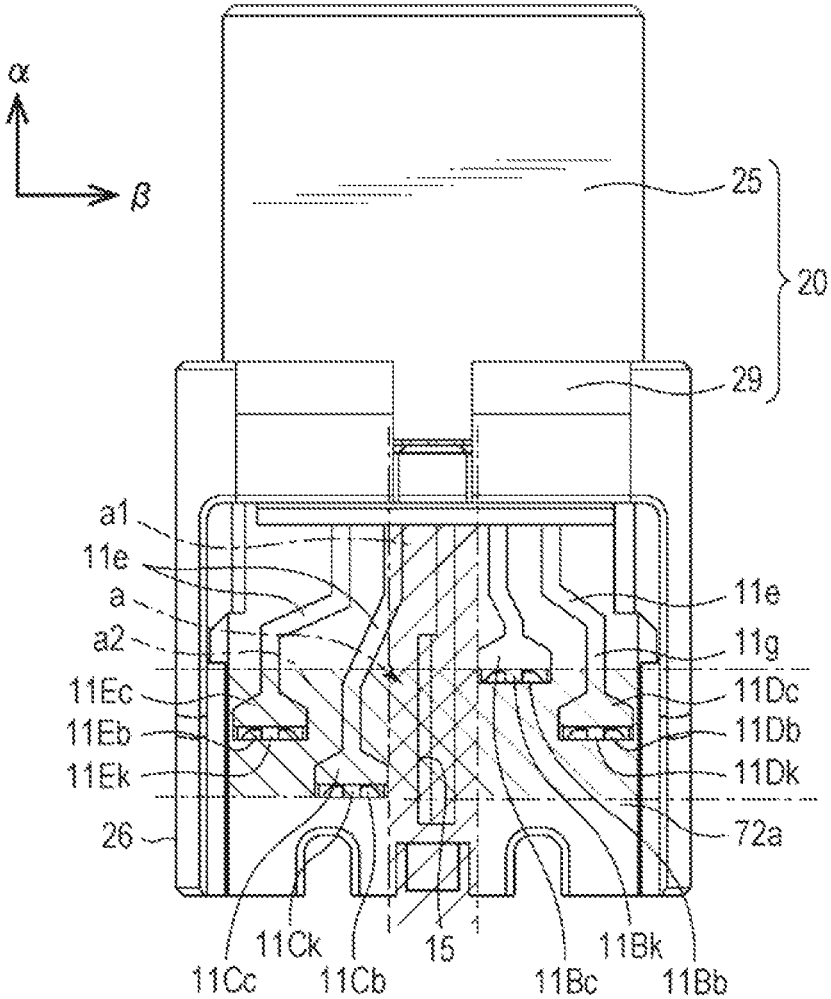
FIG. 13 is a plan view of the configuration illustrated in FIG. 12.
Figure 14:
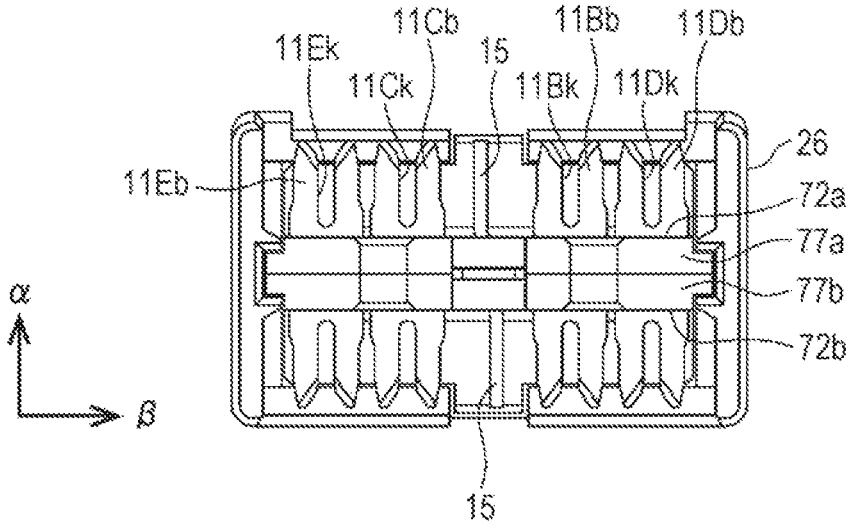
FIG. 14 is a rear view of the configuration illustrated in FIG. 12.

FIGS. 12 to 14 illustrate a modification. FIG. 12 is a diagram corresponding to, for example, FIG. 5, and illustrates a state where the cable holders 60*a* and 60*b* have been removed from the state of FIG. 3 in rear perspective view. FIG. 13 is a plan view of the configuration illustrated in FIG. 12. FIG. 14 is a rear view of the configuration illustrated in FIG. 12. In the embodiment illustrated in, for example, FIG. 1, the ground rising portion 11Ab extends substantially in the terminal-to-terminal direction "β", but may be extend in the length direction "α" as illustrated in FIGS. 12 to 14. Also in the case of extending in the length direction "α", if at least part of a ground rising portion 15 is positioned within the area of the intersection region "a" of the first virtual portion "a1" positioned in the terminal-to-terminal direction "β" between the signal rising portions 11Bb and 11Cb and the second virtual portion "a2" positioned in the length direction "α" between the signal rising portions 11Bb and 11Cb within at least one plane that is orthogonal to the height direction "γ" and spreads parallel to the principal surface 72*a*/72*b* of the terminal support member 70 as in the connector described with reference to, for example, FIG. 1, noise can be effectively reduced.

Figure 15:
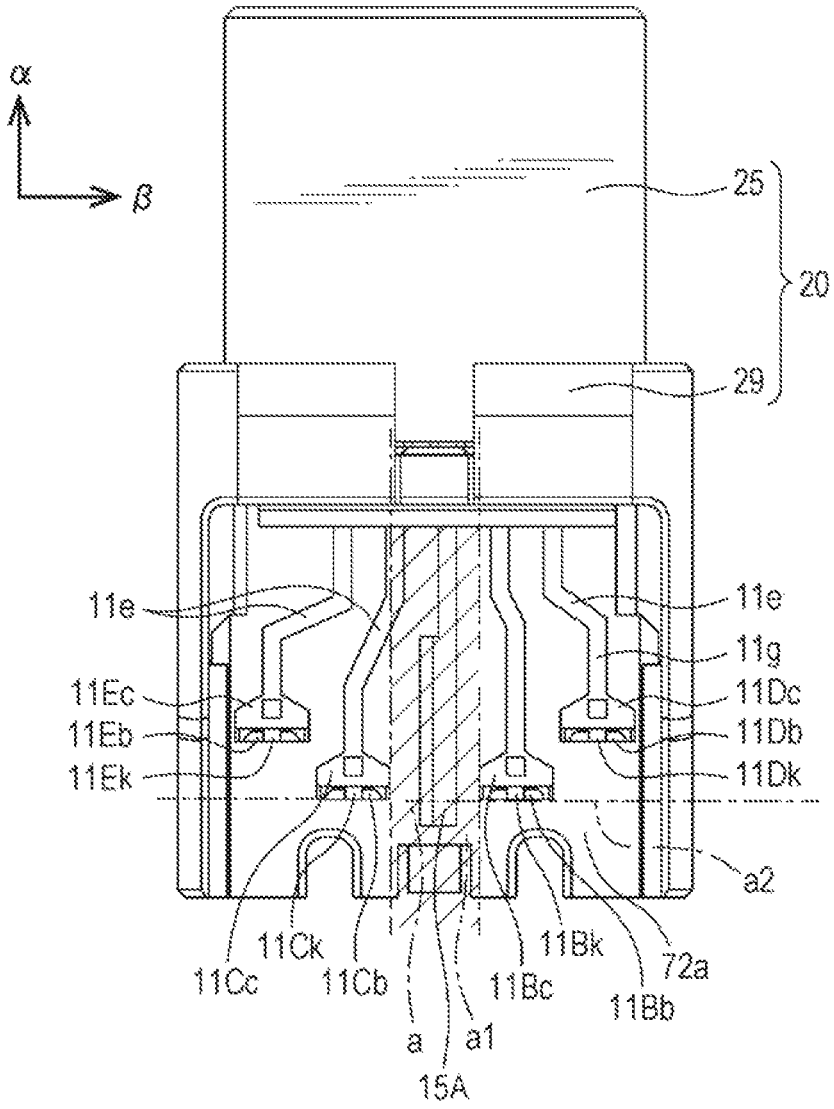
FIG. 15 is a diagram illustrating another modification.

FIG. 15 illustrates another modification. In this modification, the signal rising portions 11Bb and 11Cb are positioned at the same position in the length direction "α". As a result, the second virtual portion "a2" is linear, and the intersection region "a" where the first virtual portion "a1" and the second virtual portion (virtual line) intersect is also linear. Also in such a case, noise can be reduced by positioning the ground rising portion 15A within the area of the intersection region (linear region). However, as illustrated in this modification, if the signal rising portions 11Bb and 11Cb are positioned at the same position in the length direction "α", it is preferable that the ground rising portion 15A extend in the length direction "α" beyond the second virtual portion "a2" to, for example, a side far from a contact side with a counterpart terminal as illustrated to enhance the noise prevention effect.

Figure 16:
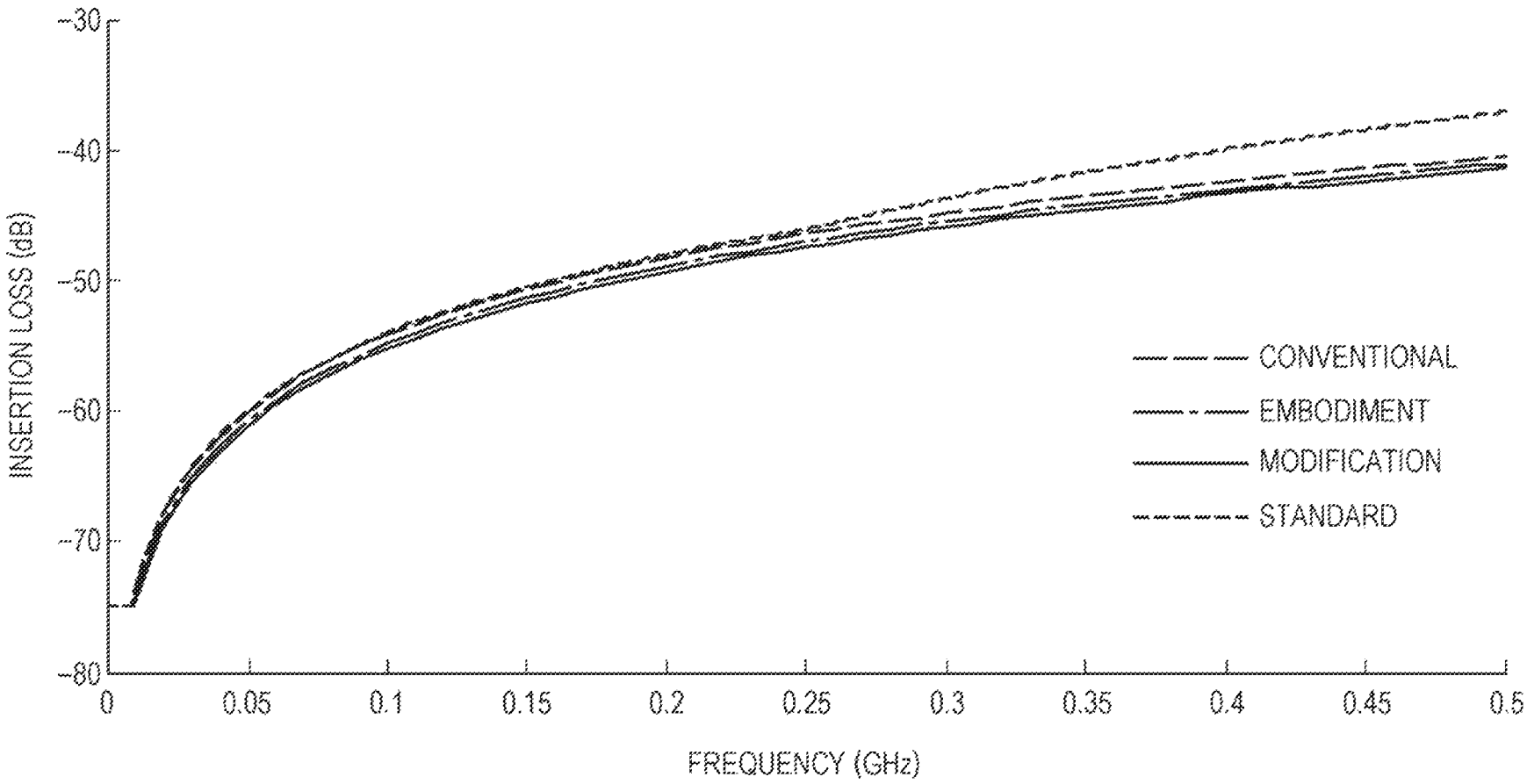
FIG. 16 is a diagram for explaining a crosstalk reduction effect.

The crosstalk reduction effect obtained by the embodiment is described with reference to FIG. 16. FIG. 16 is a graph illustrating simulation results obtained by simulating insertion loss obtained by a conventional general connector configuration, or more specifically, such a configuration without the rising portion as disclosed in, for example, Patent Literature 1, the configuration illustrated in, for example, FIG. 1 of the embodiment, and the configuration in the first modification illustrated in, for example, FIG. 13, and comparing the simulation results with a standard value of insertion loss for Category 6a based on IEEE 802.3. The horizontal axis indicates frequency (GHz), and the vertical axis indicates insertion loss (dB). "ANSYS HFSS" made by ANSYS, Inc. was used for the simulations. It was assumed that PBT (polybutyleneterephtalate) is used for the housing portion of the cable connector 10, that is, the housing 20, the cable holders 60, and the terminal support members 70, and the insulating housing 92 of the board connector 90 as the condition. As is clear from FIG. 16, the conventional general connector configuration also clears the standard value. However, according to this configuration, it is obvious that the value was further improved. In this manner, according to the present invention, a cable connector including rising portions for cable connection is provided in which transmission characteristics are excellent and connection work can be easily conducted.

The present invention is not limited to the above-mentioned embodiment, and other various modifications can be made thereto. For example, in the embodiment, the contact used for a typical four twisted pair cable has been described as an example. However, the number of cores used for the connector varies depending on the standard of a LAN cable. It can be thought that a connector used for a twisted pair cable other than the four pair can also be easily developed by applying the technical idea illustrated in the embodiment. In this manner, the present invention can also include other and different embodiments, and many of the details can be modified from various clear viewpoints without departing from the spirit and scope of the present invention. Therefore, the drawings and descriptions are simply illustrations and are not limited to them.

LIST OF THE REFERENCE NUMERALS

1 Electrical connector apparatus
10 Cable connector
11A Ground terminal
11B to 11E Signal terminal
11*b* Rising portion
11*d* Contact portion
11*g* Support portion
11*k* Groove
a Intersection region
a1 First virtual portion
a2 Second virtual portion
20 Housing
60 Cable holder
70 Terminal support member
90 Board connector

The invention claimed is:

1. A cable connector comprising:

a plurality of terminals; and a terminal support member configured to support the plurality of terminals, wherein the plurality of terminals includes at least two pairs of signal terminals placed away from each other in a terminal-to-terminal direction, and at least one ground terminal placed in the terminal-to-terminal direction between one of the two pairs of signal terminals and the other pair of signal terminals, each of the plurality of terminals includes a support portion configured to be supported by the terminal support member, a contact portion configured to be brought into contact with a counterpart terminal, and a rising portion exposed from the terminal support member, the rising portion rising from a principal surface, which has the terminal-to-terminal direction and a length direction of the terminal orthogonal to the terminal-to-terminal direction, of the terminal support member toward a cable connection side in a height direction orthogonal to both of the terminal-to-terminal direction and the length direction, the ground terminal includes a first rising portion, the signal terminal placed on a side near the ground terminal in the terminal-to-terminal direction among the signal terminals included in the one of the pairs of signal terminals includes a second rising portion, the signal terminal placed on a side near the ground terminal in the terminal-to-terminal direction among the signal terminals included in the other pair of signal terminals includes a third rising portion, and the second and third rising portions are connectable to the cable, and at least part of the first rising portion is positioned within an area of an intersection region of a first virtual portion positioned in the terminal-to-terminal direction between the second and third rising portions and a second virtual portion positioned in the length direction between the second and third rising portions within at least one plane that is orthogonal to the height direction and spreads parallel to the principal surface.

2. The cable connector according to claim 1, wherein the signal terminal placed in the terminal-to-terminal direction on a side far from the ground terminal among the signal terminals included in the one of the pairs of signal terminals includes a fourth rising portion, the signal terminal placed in the terminal-to-terminal direction on a side far from the ground terminal among the signal terminals included in the other pair of signal terminals includes a fifth rising portion, and the fourth and fifth rising portions are connectable to the cable, and the fourth rising portion is positioned in the length direction on a side nearer to a contact side with the counterpart terminal, or on a side farther from the contact side with the counterpart terminal, than the first rising portion, and the fifth rising portion is positioned correspondingly in the length direction on the side farther from the counterpart terminal, or on the side nearer to the contact side with the counterpart terminal, than the first rising portion.

3. The cable connector according claim 1, wherein the signal terminal placed in the terminal-to-terminal direction on a side far from the ground terminal among the signal terminals included in the one of the pairs of signal terminals includes a fourth rising portion, the signal terminal placed in the terminal-to-terminal direction on a side far from the ground terminal among the signal terminals included in the other pair of signal terminals includes a fifth rising portion, and the fourth and fifth rising portions are connectable to the cable, and the fourth and fifth rising portions are positioned at the same position in the length direction.

4. The cable connector according to claim 1, wherein the rising portion includes a portion extending in the terminal-to-terminal direction.

5. The cable connector according to claim 1, wherein the rising portion includes a portion extending in the length direction.

6. The cable connector according to claim 1, wherein the rising portion includes a groove for cutting along the height direction, the rising portion being configured to be capable of cutting part of the cable.

7. The cable connector according to claim 1, wherein between the plurality of terminals, at least the support portions and the contact portions of the terminals have the same lengths in the length direction, and are positioned at the same heights in the height direction ($\gamma$).

8. The cable connector according to claim 1, wherein the second and third rising portions are positioned at the same position in the length direction.

9. The cable connector according to claim 8, wherein the first, second, and third rising portions are positioned at the same position in the length direction.

10. The cable connector according to claim 1, wherein one of the second and third rising portions is positioned in the length direction on a side nearer to a contact side with the counterpart terminal, or on a side farther from the contact side with the counterpart terminal, than the first rising portion, and the other is positioned correspondingly in the length direction on the side farther from the contact side with the counterpart terminal, or the side nearer to the contact side with the counterpart terminal, than the first rising portion.

11. The cable connector according to claim 10, wherein the first, fourth, and fifth rising portions are positioned at the same position in the length direction.

12. The cable connector according to claim 10, wherein the first, second, and fourth rising portions form an isosceles triangle with the second rising portion as the apex.

13. The cable connector according to claim 10, wherein the first, third, and fifth rising portions form an isosceles triangle with the third rising portion as the apex.

* * * * *